US005319340A

United States Patent [19]

Leupold

[11] Patent Number: 5,319,340

[45] Date of Patent: Jun. 7, 1994

[54] BI-CHAMBERED MAGNETIC IGLOO

[75] Inventor: Herbert A. Leupold, Eatontown, N.J.

[73] Assignee: The United States of America as represented by the Secretary of the Army, Washington, D.C.

[21] Appl. No.: 102,022

[22] Filed: Jul. 28, 1993

[51] Int. Cl.[5] ..... H01F 7/02; H01F 7/08; H01J 23/08

[52] U.S. Cl. ..... 335/306; 335/210; 335/214; 315/5.35; 372/2

[58] Field of Search ..... 335/306, 210, 212, 297, 335/298; 315/4, 5, 5.34, 5.35; 372/2

[56] References Cited

U.S. PATENT DOCUMENTS

| | | | |
|---|---|---|---|
| 4,731,598 | 3/1988 | Clarke | 335/210 |
| 4,831,351 | 5/1989 | Leupold | 335/306 |
| 4,835,137 | 5/1989 | Leupold | 505/1 |
| 4,835,506 | 5/1989 | Leupold | 335/306 |
| 4,837,542 | 6/1989 | Leupold | 335/306 |
| 4,859,976 | 8/1989 | Leupold | 335/306 |
| 4,861,752 | 8/1989 | Leupold | 505/1 |
| 4,887,058 | 12/1989 | Leupold | 335/216 |
| 5,084,690 | 1/1992 | Leupold | 335/306 |
| 5,245,621 | 9/1993 | Leupold | 372/37 |

OTHER PUBLICATIONS

H. A. Leupold, "Magnetic-field source for bi-chambered electron-beam devices", Journal of Applied Physics No. 67 (9), 1 May 1990.

*Primary Examiner*—Leo P. Picard
*Assistant Examiner*—Stephen T. Ryan
*Attorney, Agent, or Firm*—Michael Zelenka; James A. Digiorgio

[57] ABSTRACT

A magnetic field source that produces a stepped field of greater magnitude than the remanence of the magnetic material used to construct it. The source is basically a magnetic igloo comprised of two hemispheres having different cavity flux value that are separated by a passive ferromagnet slab. The hemispheres are positioned such that they share the same radial center point. The slab has a predetermined thickness and a tunnel of predetermined radius passing through its center along the radial center point of said hemispheres such that the flux in the cavity of the hemisphere abruptly changes when passing from the first hemisphere flux to the second.

5 Claims, 1 Drawing Sheet

BI-CHAMBERED MAGNETIC IGLOO

GOVERNMENT INTEREST

The invention described herein may be manufactured, used, and licensed by or for the Government of the United States of America for governmental services without the payment to us of any royalty thereon.

FIELD OF THE INVENTION

This invention relates generally to the field of magnetic field sources, and more specifically to gyrotron-type devices that generate magnetic fields which vary in strength along the path of a radiation-generating electron beam.

BACKGROUND OF THE INVENTION

Some microwave applications require a strong magnetic field that varies in strength along the path of a radiation-generating electron beam. For example, a gyrotron-type device requires an abrupt step-like magnetic field that varies along an electron beam path. Such gyrotron-type devices comprise a tandem of coaxial chambers made of permanent magnet structures wherein each chamber generates a uniform axial magnetic field having a predetermined magnitude and direction. Since each chamber in tandem can be configured to generate a magnetic field different from the other chamber, the magnetic field at the juncture of the two chambers may be configured to have a step profile.

Many gyrotron-type devices do not require that there be a perfect step profile as a function of distance along the axis of the bi-chambered device. It has been recognized by those skilled in the art, however, that the ability to produce a gyrotron-type device having such a perfect step profile would be a useful addition to the repertoire of field forms attainable with permanent magnets.

A first step in the attainment of such a device was disclosed in an article entitled "Magnetic-field source for bi-chambered electron-beam devices," authored by the applicants in the Journal of Applied Physics No. 67 (9), on May 1, 1990. In this article it was disclosed that the broad transition in the magnetic field values between the juncture of the two chambers can be sharpened by implementing a radially magnetized permanent magnet ring at the juncture of the chambers. The ring was placed in the interior rather than on the outside of the device to prevent unwanted polarization of the iron pole pieces at the joints as the magnetic ring produces a smaller field at its exterior.

Smoothing of the field transition can also be accomplished by the addition of axially magnetized rings whose fields are equivalent to the changes resulting from an alteration in the remanence in the supply magnet at the location in question.

Such field transition sharpening techniques are effective on these devices only when the required fields are on the order of, but no greater than, one-half the coercivity of the permanent magnet materials that comprise the structure.

Consequently, those skilled in the art recognize the need for a device that can provide a stepped internal field having a magnitude greater than that of one-half the coercivity of the permanent magnet materials that comprise the shell without adding to the overall size and cost of the device.

SUMMARY OF THE INVENTION

Accordingly, the general purpose of this invention is to provide a gyrotron-type device that produces a stepped magnetic field within its cavity having coercivity greater than the magnetic material of which it is constructed. This object is achieved by utilizing a magic igloo structure comprised of co-based half-spheres (having the same radial center point) that do not have the same coercivity.

In a preferred embodiment, two half-spheres each producing an internal field of a different predetermined magnitude are attached through an iron slab having a predetermined thickness and a tunnel of predetermined radius connecting the cavity from one half-sphere to the other. Consequently, the iron slab separates the half-spheres, sharpens the transition in magnitude from one field to the next, and provides a communication path to the cavity magnetic field in each half-sphere.

The abruptness of the transition from one cavity field to the next depends on both the diameter of the tunnel connecting the cavities and the thickness of the iron slab. If the tunnel is sufficiently small in diameter, the transition width is essentially the length of the tunnel.

DETAILED DESCRIPTION OF THE INVENTION

Figure 1:
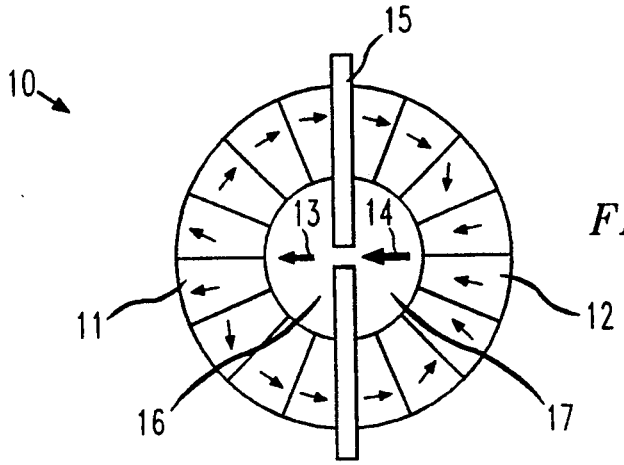
FIG. 1 is a pictorial view of the preferred embodiment showing iron slab between the two half-spheres each producing an internal field of a different magnitude.

Referring now to the drawings there is shown three different embodiments of the invention. In FIG. 1 there is shown bichambered magnetic igloo 10 comprised of permanent magnet half-spheres 11 and 12 which have different coercivity, and thus produce different cavity fields 13 and 14, respectively. Half-spheres 11 and 12 are attached through iron slab 15 having a predetermined thickness and a tunnel of predetermined radius connecting cavities 16 and 17 of half-spheres 11 and 12, respectively.

Figure 2:
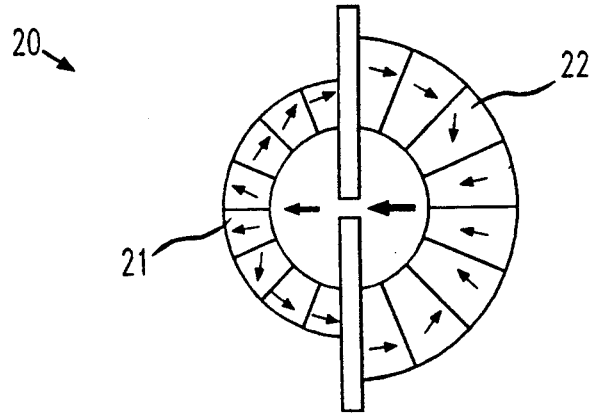
FIG. 2 is a pictorial view of an alternate embodiment of the invention wherein the larger half-sphere shell produces a larger internal field than the other (smaller) half-sphere.
Figure 3:
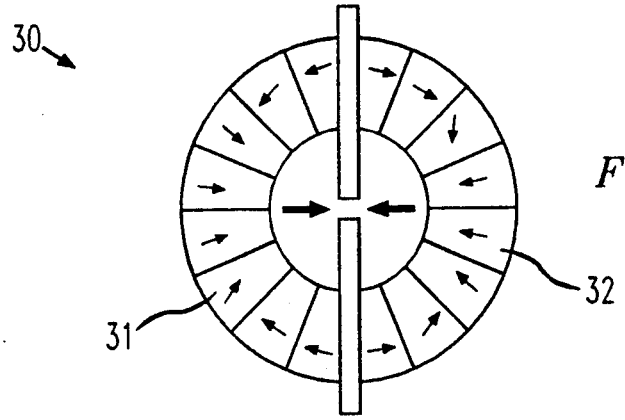
FIG. 3 is a pictorial view of an alternate embodiment of the invention wherein each half-sphere produces a cavity field that points in the opposite direction of, and has a different magnitude than, the other half-sphere.

FIGS. 2 and 3 show alternate embodiments 20 and 30 of the invention. In FIG. 2 there is shown alternate embodiment 20 comprised of permanent magnet half-spheres 21 and 22 that have a different outer radius as well as a different coercivity from each other. In FIG. 3, however, there is shown embodiment 30 comprised of permanent magnet half-spheres 31 and 32 having substantially the same outer radius but producing cavity fields pointing in opposite directions and having different predetermined magnitudes.

It is evident from the drawings and the above description that many different embodiments can be designed to produce stepped magnetic cavity fields of many different magnitudes. As described above, the abruptness of the transition from one cavity field to the next depends on both the diameter of the tunnel through the iron material connecting the cavities and the thickness of the iron material. Consequently, many other modifications and variations of the present invention are possible in the light of the above teachings.

What is claimed is:

1. A bi-chambered high-field magnetic igloo, comprising:

a first permanent magnet hemi-sphere generating a radial magnetic flux of predetermined magnitude and direction within its cavity;

a second permanent magnet hemi-sphere generating a radial magnetic flux of predetermined magnitude and direction within its cavity, said second hemisphere positioned such that its radial center point occupies substantially the same point in space as said first hemisphere, said magnitude of said second hemisphere cavity flux differing from said magnitude of said first hemisphere cavity flux by some predetermined amount; and a passive ferromagnetic slab of predetermined thickness positioned between said first and second hemispheres, said slab having a tunnel of predetermined radius passing through its center along said radial center point of said hemispheres such that said magnetic field value abruptly changes when traversing said cavity from said first hemisphere to said second hemisphere.

2. The igloo of claim 1 wherein said first hemisphere has a different outer radius than said first hemisphere.

3. The igloo of claim 2 wherein said cavity flux of said first hemisphere has a different direction than said second hemisphere.

4. The igloo of claim 1 wherein said first hemisphere has a different coercivity than said second hemisphere.

5. The igloo of claim 4 wherein said cavity flux of said first hemisphere has a different direction than said second hemisphere.

* * * * *